US007640967B2

(12) United States Patent
Bradley et al.

(10) Patent No.: US 7,640,967 B2
(45) Date of Patent: Jan. 5, 2010

(54) THERMOSYPHON HEAT REDUCTION SYSTEM FOR A MOTOR VEHICLE ENGINE COMPARTMENT

(75) Inventors: James C. Bradley, New Haven, IN (US); Christina Marshall, Fort Wayne, IN (US); Rodney J. Klinger, Fort Wayne, IN (US); Scott A. Wooldridge, Fort Wayne, IN (US); Joseph T. Penaloza, Fort Wayne, IN (US)

(73) Assignee: International Truck Intellectual Property Company, LLC, Warrenville, IL (US)

( * ) Notice: Subject to any disclaimer, the term of this patent is extended or adjusted under 35 U.S.C. 154(b) by 570 days.

(21) Appl. No.: 11/249,000

(22) Filed: Oct. 12, 2005

(65) Prior Publication Data

US 2007/0079622 A1 Apr. 12, 2007

(51) Int. Cl.
*B60H 1/00* (2006.01)
*F01N 5/02* (2006.01)
*F24H 9/02* (2006.01)

(52) U.S. Cl. ..... 165/41; 165/51; 165/52; 165/104.21; 165/128; 165/129; 123/553; 237/12.3 A

(58) Field of Classification Search ..... 165/41, 165/51, 52, 104.21, 104.26, 128, 129, 130, 165/131; 123/553; 237/12.3 A
See application file for complete search history.

(56) References Cited

U.S. PATENT DOCUMENTS 1,795,044 A * 3/1931 Rundlett ..... 165/130
1,795,045 A * 3/1931 Rundlett ..... 165/129
2,496,189 A * 1/1950 Williams ..... 165/128
3,876,245 A * 4/1975 Lowery ..... 165/128
3,927,651 A * 12/1975 Harrow et al. ..... 165/104.21
3,935,849 A * 2/1976 Mills ..... 165/104.21
3,939,813 A * 2/1976 Harrow et al. ..... 123/553
3,986,665 A * 10/1976 Kofink et al. ..... 165/52
4,011,849 A * 3/1977 Latham ..... 165/51
4,087,047 A * 5/1978 Wulf et al. ..... 165/41
4,126,111 A * 11/1978 Hafner et al. ..... 123/553
4,140,173 A * 2/1979 Wulf et al. ..... 237/12.3 A
4,146,176 A * 3/1979 Beauvais et al. ..... 237/12.3 A
4,415,118 A * 11/1983 Endo ..... 237/12.3 A
4,421,159 A * 12/1983 Lin ..... 165/41
4,561,387 A * 12/1985 Korkemeier et al. ..... 165/128
5,272,891 A 12/1993 Erickson
5,327,734 A 7/1994 Haynes et al.

* cited by examiner

*Primary Examiner*—Ljiljana (Lil) V Ciric
(74) *Attorney, Agent, or Firm*—Jeffrey P. Calfa; Mark C. Bach

(57) ABSTRACT

A system (10) and method for removing heat from an engine compartment in a motor vehicle where heat generated by operation of a heat engine (12) that propels the vehicle tends to collect. Engine heat is collected in a thermofluid in a reservoir forming an evaporator (14) where the thermofluid absorbs heat sufficient to evaporate it. The vapor naturally migrates to a condenser (22) that is cooled sufficiently to condense the vapor back to liquid phase. The liquid falls by gravity back to the condenser.

7 Claims, 4 Drawing Sheets

THERMOSYPHON HEAT REDUCTION SYSTEM FOR A MOTOR VEHICLE ENGINE COMPARTMENT

FIELD OF THE INVENTION

This invention relates to motor vehicles that are powered by heat engines and more particularly to a system for removing heat from any location in a vehicle that is prone to undesirably high temperatures, especially heat generated by a heat engine in an engine compartment.

BACKGROUND OF THE INVENTION

The nature of the thermodynamic cycle on which a heat engine operates requires that heat of combustion be rejected to a waste heat medium. In an air-cooled engine, the medium is air that surrounds the engine. In a liquid-cooled engine, the medium is liquid that circulates through coolant passages in the engine where it is heated before passing to a radiator where the heat is transferred to air that flows through the radiator, although some amount of heat is also rejected directly to air surrounding the engine by radiation and convection.

A motor vehicle typically houses the engine in some sort of a compartment. Most cars and trucks have a front engine compartment that is bounded frontally by a front end structure that includes the radiator and rearwardly by the occupant compartment, or cab. The sides of the engine compartment are bounded by fender structures, and the top by a hood that can be opened to provide access to the engine compartment.

Underhood temperature is a matter of concern to vehicle designers because excessively high temperatures can have adverse effects on the performance and durability of various devices and systems. Space within an engine compartment is often at a premium, and the more crowded an engine compartment becomes, more components are exposed to engine compartment heat, and the movement of air through the engine compartment that can aid to some extent in limiting underhood temperatures becomes more difficult.

Engine operating temperature is affected by various factors. Higher operating temperatures may be necessary in order to enable compliance with relevant emission control regulations. That can add to engine compartment heating.

The cooling system of a liquid cooled engine is typically sized to allow the engine to operate at a desired engine operating temperature, but even when a cooling system is sized to accommodate higher engine operating temperatures, more engine heat is transferred by convention, conduction, and/or radiation to devices in the engine compartment, to the structure bounding the engine compartment, and to air in the engine compartment, and that heat isn't removed by the liquid cooling system. Moreover, placement of a radiator in certain vehicles causes at least some of the engine heat that is rejected at the radiator to pass through the engine compartment.

SUMMARY OF THE INVENTION

The present invention relates to a system for removing significant engine heat from an engine compartment in a motor vehicle, especially heat generated by operation of a heat engine in an engine compartment. By using the thermosyphon principle, the inventive system enables heat to be removed by natural circulation of thermofluid thereby rendering the system passive in the sense that it does not draw power from either the engine or the electrical system. The amount of heat that can be removed can be large enough to provide a significant limitation on excessive underhood temperatures.

The invention can be adapted for various types of vehicles, including those having front engine compartments as described above, and also "cab-over" vehicles. Moreover, components of the inventive system can be constructed to fit in ways that are not overly intrusive. For example, an evaporator can be constructed with a small vertical dimension (thickness) and a more expansive length and width for overlying the expanse of an engine both fore-and-aft and side-to-side.

According to one generic aspect, the invention relates to a motor vehicle comprising a chassis supporting a heat engine that propels the vehicle, and a thermosyphon system that comprises a collector that collects heat generated by running the engine and transfers collected heat to a thermofluid that due to heating is forced to circulate to a dissipator where heat is rejected and then back to the collector to collect more heat.

According to another generic aspect, the invention relates to a method of removing heat from a space in a motor vehicle where heat generated by operation of a heat engine that propels the vehicle tends to collect. Engine heat is collected via a collector that transfers collected heat to a thermofluid to force the thermofluid to circulate to a dissipator where heat is rejected and from the dissipator back to the collector.

The foregoing, along with further features and advantages of the invention, will be seen in the following disclosure of a presently preferred embodiment of the invention depicting the best mode contemplated at this time for carrying out the invention. This specification includes drawings, now briefly described as follows.

DESCRIPTION OF THE PREFERRED EMBODIMENT

Figure 1:
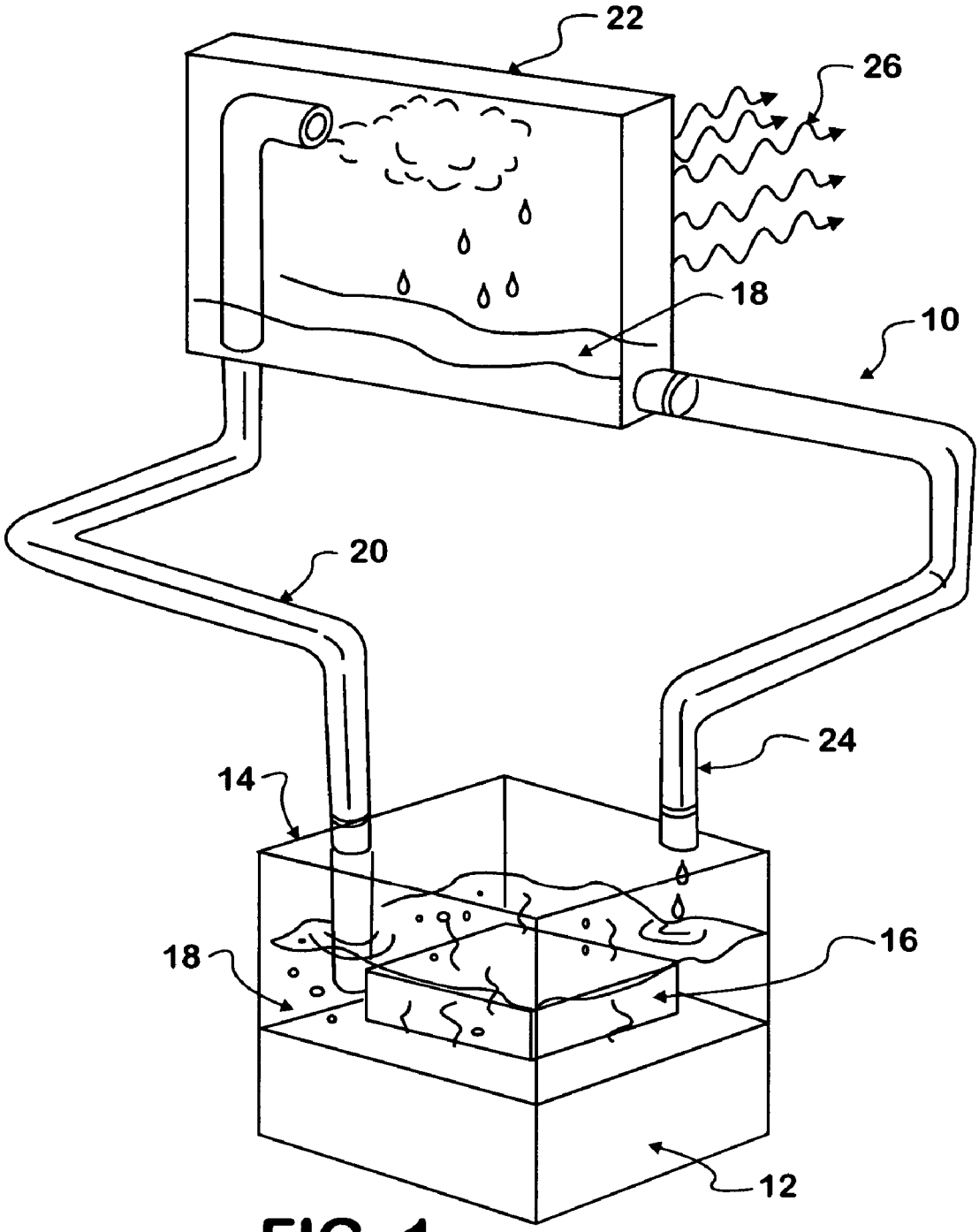
FIG. 1 is a schematic diagram illustrating principles of a thermosyphon in application to a motor vehicle engine compartment in accordance with the present invention.

FIG. 1 shows a schematic representation of a thermosyphon system 10 associated a heat engine 12 in a motor vehicle, such as a truck. Engine 12 is mounted on a chassis frame and forms the powerplant that propels the vehicle.

System 10 comprises a reservoir 14 and a heat collector 16. The latter is disposed to collect heat from engine 12 via conduction and/or convention, and/or radiation. Removal of heat by conduction occurs when collector 16 is placed in physical contact with engine 12. Removal of heat by convection occurs when air that has been heated passes across a surface of collector 16. Removal of heat by radiation occurs when collector 16 is radiantly heated by engine 12. Collector 16 transfers collected heat to thermofluid 18 in reservoir 14.

By making collector 16 a "black body" as that term is understood in physics, it becomes an ideal absorber of radiant heat. Hence, a surface of collector 16 is exposed to the radiant heat source, and it is through that surface that collector 16 is heated. Heat is removed from collector 16 by transfer to thermofluid 18 in reservoir 14. Because FIG. 1 is schematic, it should not be construed to imply that collector 16 is disposed entirely inside reservoir 14. A collector can be a separate element assembled to a reservoir, or it can be a portion of a wall of the reservoir.

System 10 comprises a closed circuit through which thermofluid 18 naturally circulates when the system is removing heat from engine 12. A conduit 20 conveys thermofluid from reservoir 14 to a dissipater, or condenser, 22. A conduit 24 conveys thermofluid from dissipater 22 to reservoir 14.

Reservoir 14 forms an evaporator where thermofluid in liquid phase is evaporated to gas phase by engine heat collected by collector 16 and transferred to the thermofluid. The rate of evaporation depends on factors such as the temperature to which liquid is heated, with heating of liquid to its boiling point typically creating the greatest rate of evaporation.

Because the vapor tends to rise, it migrates through conduit 20 to the higher elevation of dissipater 22. The latter is constructed and arranged to transfer thermofluid heat to any suitable medium, such as air 26, at a location remote from the engine compartment within which engine 12 is located. Consequently, as the thermofluid vapor gives up heat to air 26, it begins to condense within dissipater 22. Liquid fluid collects at the bottom of dissipater 22 where the entrance to conduit 24 is located. The condensate then falls by gravity through conduit 24 to return to reservoir 14 where it can be re-heated.

Thus, a continuous natural circulation of thermofluid through system 10 can continually remove heat from the engine compartment.

Figure 2:
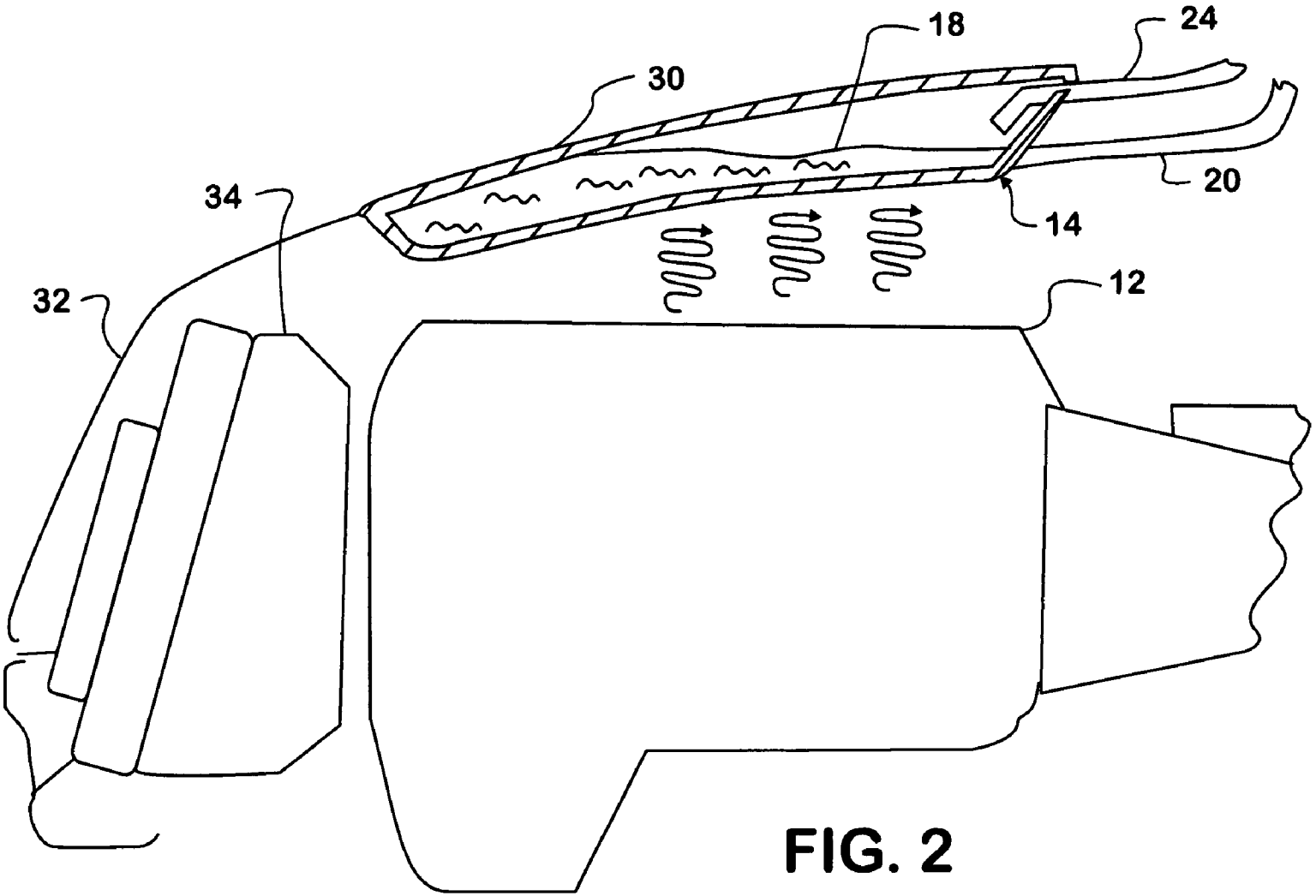
FIG. 2 is a left side elevation view of an internal combustion engine inside an engine compartment at a front of a motor vehicle, including a portion of a thermosyphon system.

FIG. 2 shows placement of a suitably shaped reservoir 14 on the underside of a hood 30 covering an engine compartment at the front of a motor vehicle forward of an occupant compartment or cab. The reservoir is relatively small vertically and has a broad horizontal expanse to overlie engine 12 in spaced relation to the top of the engine when hood 30 is closed as shown. This means that the reservoir's average vertical dimension is smaller than its average horizontal dimensions. Conduits 20 and 24 are arranged to flex with the hood as the latter swings open to expose engine 12 inside the engine compartment. The engine compartment is forwardly bounded by a front end 32 that includes a cooling module 34 containing a radiator. Dissipater 22 is not specifically shown, but is placed at any suitable location. FIG. 2 does not specifically identify the collector by its reference numeral, but this is an example of where the collector can be incorporated as the bottom wall of the reservoir constructed of a material that is a good absorber of radiant energy.

Figure 3:
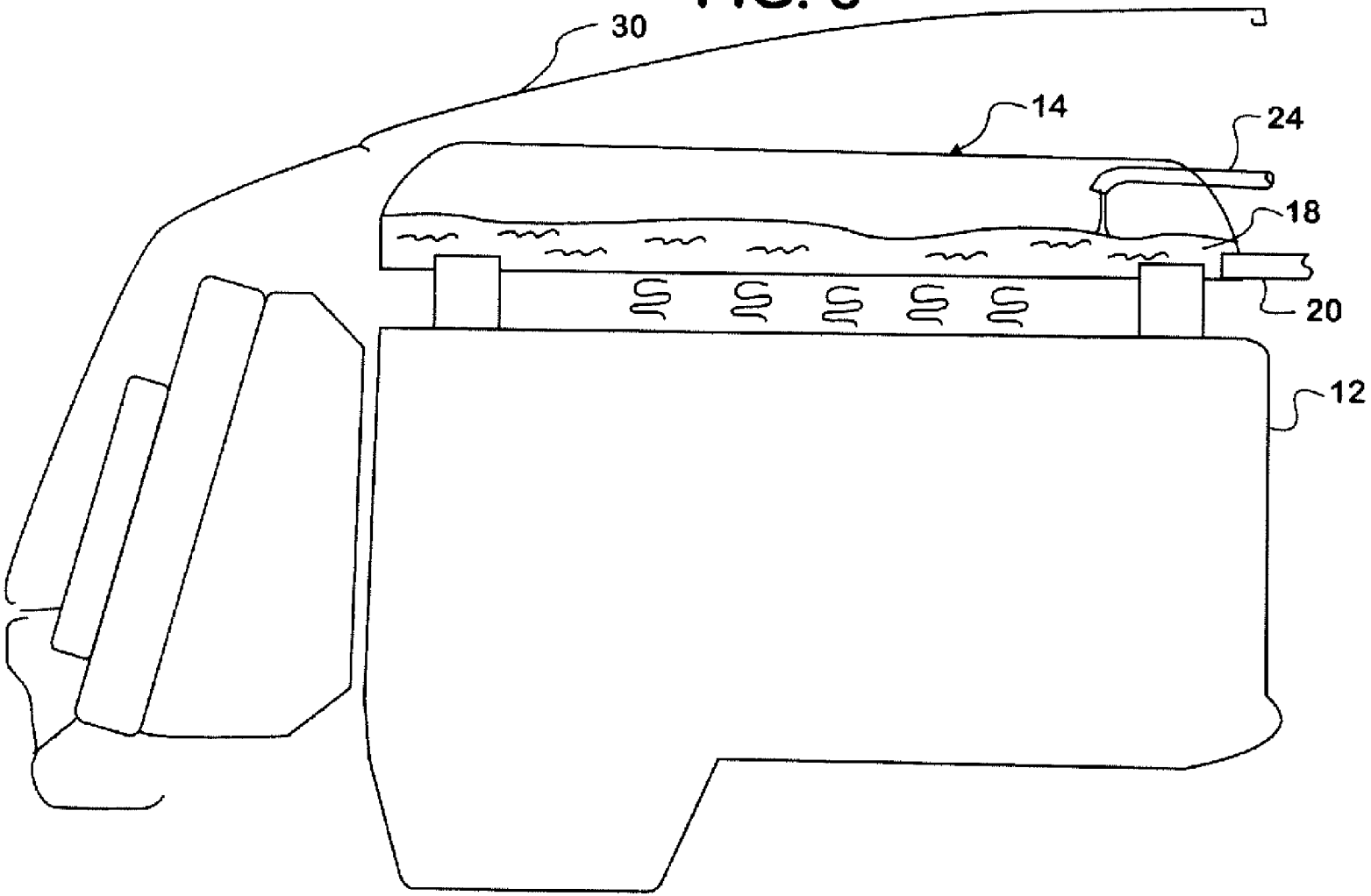
FIG. 3 is a left side elevation view similar to a portion of FIG. 2 but showing a further embodiment of the invention.

FIG. 3 shows placement of a suitably shaped reservoir 14 atop engine 12 below the hood, which is not specifically shown. This reservoir is also relatively small vertically and has a broad horizontal expanse to overlie the engine with some clearance to both the top of the engine and also to the overlying hood. Conduits 20 and 24 do not have to flex with opening and closing of the hood. Dissipater 22 is not specifically shown, but is placed at a suitable location. Here too the reservoir wall can form the collector.

Figure 4:
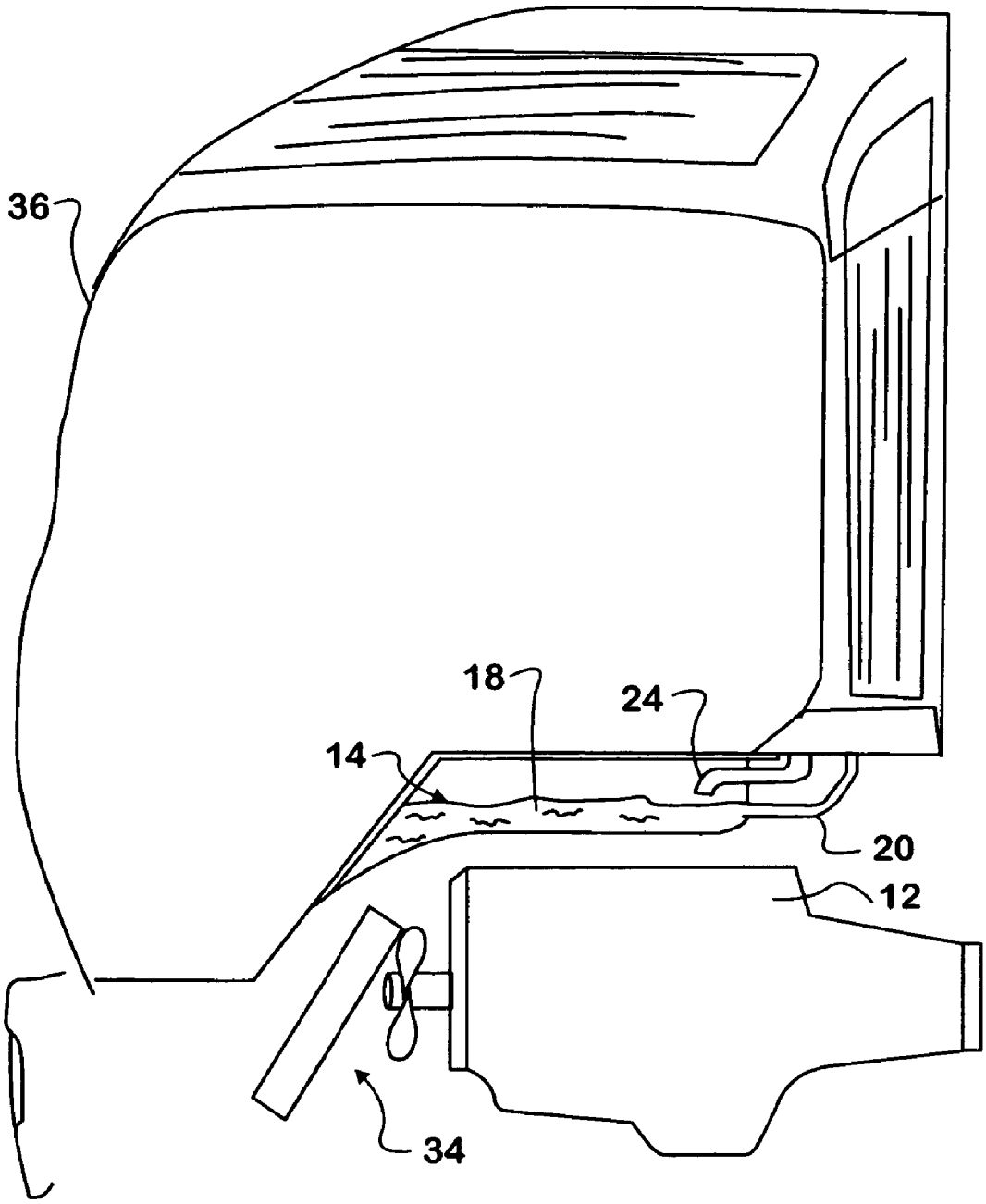
FIG. 4 is a left side elevation view of an internal combustion engine inside an engine compartment of a cab-over type motor vehicle, including a portion of a thermosyphon system.

FIG. 4 shows placement of a suitably shaped reservoir 14 on the underside of the floor of the cab 36 of a "cab-over" type vehicle where the reservoir is in overlying relation to engine 12. A cooling module 34 is disposed in front of engine 12. This reservoir is also relatively small vertically and has a broad horizontal expanse to overlie engine 12 in spaced relation to the top of the engine. Conduits 20 and 24 do not have to flex in as much as the entire cab swings upwardly and forwardly to expose the engine. Dissipater 22 is also not specifically shown, but is placed at a suitable location. An aerodynamic pod is mounted atop the cab roof, and the dissipator can associated and/or integrated with the pod to render it effective for heat transfer to air without being visibly prominent.

It is believed that certain components that convey fluids involved in combustion processes occurring in a heat engine can benefit by association with a thermosyphon system. For example, an EGR (exhaust gas recirculation) valve conveys hot exhaust gases from the exhaust system to the intake system and often requires an associated an EGR cooler to cool the exhaust gases before they enter the valve. Associating the thermosyphon system with an EGR valve could eliminate the need for a separate EGR cooler. Similarly charge air from the compressor of a turbocharger typically passes through a charge air cooler, and use of the thermosyphon system to cool charge air could perform that function.

Because a motor vehicle may operate in geographical areas that experience a substantial range of temperatures, a thermofluid should be selected for suitability over the relevant temperature range.

While a presently preferred embodiment of the invention has been illustrated and described, it should be appreciated that principles of the invention apply to all embodiments falling within the scope of the following claims.

What is claimed is:

1. A motor vehicle comprising:

a chassis supporting an engine compartment, in the engine compartment, a heat engine that propels the motor vehicle;

a thermosyphon system comprising a collector that collects heat generated by running the heat engine and transfers that collected the heat to the thermofluid, a dissipator connected by conduits to the reservoir, wherein, upon heating, the thermofluid circulates to the dissipator to reject heat from the thermofluid and then for thermofluid and back to the collector to collect more heat, the thermofluid circulating via a reservoir disposed inside the engine compartment, the reservoir being in overlying relation to the heat engine, and wherein the collector is disposed to heat thermofluid in the reservoir.

2. The motor vehicle as set forth in claim 1 wherein the reservoir has an average vertical dimension and an average horizontal dimension, the average vertical dimension being smaller than the average horizontal dimension.

3. The motor vehicle as set forth in claim 2 wherein the motor vehicle comprises a hood closing an otherwise open top of the engine compartment, and the reservoir disposed atop the heat engine and remaining so disposed when the hood is operated to open the engine compartment.

4. The motor vehicle as set forth in claim 1 wherein the collector is a wall of the reservoir.

5. The motor vehicle as set forth in claim 1 wherein the thermofluid circulates in a gas phase from the collector to the dissipator and the thermofluid circulates in a liquid phase from the dissipator to collector.

6. The motor vehicle as set forth in claim 5 wherein the reservoir for the thermofluid is disposed in association with the collector such that heat collected by the collector evaporates thermofluid in the reservoir to a liquid phase.

7. The motor vehicle as set forth in claim 6 wherein the dissipator condenses the thermofluid from a gas phase to a liquid phase as heat is rejected and the dissipator is arranged relative to the reservoir to allow the liquid phase to return by gravity to the reservoir.

* * * * *